US007114360B2

(12) United States Patent
Ikeda

(10) Patent No.: US 7,114,360 B2
(45) Date of Patent: Oct. 3, 2006

(54) PLATE BENDING MACHINE

(75) Inventor: Toshio Ikeda, Takaoka (JP)

(73) Assignee: Kyowa Machine Co., Ltd., Takaoka (JP)

( * ) Notice: Subject to any disclaimer, the term of this patent is extended or adjusted under 35 U.S.C. 154(b) by 0 days.

(21) Appl. No.: 11/142,410

(22) Filed: Jun. 2, 2005

(65) Prior Publication Data

US 2005/0268683 A1 Dec. 8, 2005

Related U.S. Application Data

(63) Continuation of application No. PCT/JP03/01280, filed on Feb. 6, 2003.

(51) Int. Cl.
*B21D 5/04* (2006.01)

(52) U.S. Cl. ..... 72/306; 72/323

(58) Field of Classification Search ..... 72/323, 72/319, 316, 306, 387, 388; 29/243.58
See application file for complete search history.

(56) References Cited

U.S. PATENT DOCUMENTS 4,356,716 A * 11/1982 Aschauer ..... 72/322
4,411,148 A * 10/1983 Aschauer et al. ..... 72/306
4,843,862 A * 7/1989 Salvagnini ..... 72/319
6,470,727 B1 * 10/2002 Kunze ..... 72/323
6,662,619 B1 12/2003 Ikeda

FOREIGN PATENT DOCUMENTS

| | | |
|---|---|---|
| EP | 1 057 548 A2 | 12/2000 |
| JP | A 7-164058 | 6/1995 |
| JP | A 2001-18012 | 1/2001 |

* cited by examiner

*Primary Examiner*—Daniel C. Crane
(74) *Attorney, Agent, or Firm*—Oliff & Berridge, plc

(57) ABSTRACT

A plate bending machine for bending a plate clamped between a lower die and a pressure die by a blade of a bending die mounted on a bend beam which is controlled in the vertical and horizontal directions. The bend beam has a vertical cross-section of substantially C-shaped configuration, and includes a first bending die attached to an upper portion of the substantially C-shaped configuration and a second bending die attached to a lower portion of the same. Blades are formed on at least one of the first and second bending dies to extend in the upward and downward directions, respectively. The horizontal bend arm may be connected to one end of a vertical bend arm which is disposed substantially vertically, by a shaft B (eccentric shaft).

8 Claims, 6 Drawing Sheets

PLATE BENDING MACHINE

CROSS REFERENCE TO RELATED APPLICATION

This application is a continuation of International Patent Application No. PCT/JP03/01280, having an international filing date of Feb. 6, 2003, which designated the United States, the entirety of which is incorporated herein by reference.

BACKGROUND OF THE INVENTION

The present invention relates to a plate bending machine which bends a plate clamped between a lower die and a pressure die by a blade of a bending die mounted on a bend beam which is controlled in the vertical and horizontal directions, and particularly relates to the structure of such a bending section.

As shown in FIG. 4 illustrating a side view of a plate bending machine, for example, there is known a plate bending process which includes the steps of clamping a plate 1 between a lower die 3 and an upper pressure die 2 in cooperation with each other and providing a bend beam 110*a* on which a bending die 107 is mounted at the tip end thereof, the bending die 107 including an upward extending blade 132 and a downward extending blade 131, whereby the plate 1 can be upward-bent by upwardly pressing the plate through the blade 132 at the approaching position in the underside of the plate and can be reverse-bent by downwardly pressing the plate through the blade 131 at the approaching position in the upper portion of the plate.

In such an arrangement, the bend beam 110*a* includes a horizontal bend arm 111*a* connected at one end to a shaft A (or eccentric shaft 113*a*) and a vertical bend arm 112*a* having its lower end connected to another shaft D (or eccentric shaft 114*a*), the upper ends of the horizontal and vertical bend arms being coupled together by a pivot pin 115*a*.

Therefore, the shafts A and D can cooperate with each other to control the bending trace in the blades.

FIG. 5 A is a front view of a main part of such a plate bending machine while FIG. 5 B is a top plan view of the same.

In these figures, the lower die portion is omitted for simplicity.

These figures schematically represent a linkage and crank mechanism for the sake of clarity.

The rotation of the shaft A (or eccentric shaft 113*a*) and shaft D (eccentric shaft 114*a*) is controlled by a drive means 21 such as a servo motor through a speed reducer 23 or the like.

Reference numerals 22 and 28 denote bearing mechanisms which are supported by the corresponding frames (not shown).

Since the structure shown in FIG. 4 can use the blade 132 for upward-bending in the upward direction and the blade 131 for reverse-bending in the downward direction, it is advantageous in that the blade to be used can be selected merely by rotating the eccentric shaft D (eccentric shaft 114*a*) without exchanging the bending dies which have different blades.

Since the forward end of the plate can more deeply be inserted into such a bending structure as shown in FIG. 4 without interference with the bending die, the width of the plate to be bent can be increased. However, the interference between the lower blade 131 and the lower die 3 must be avoided when the upward-bending trace is to be controlled by the upper blade 132.

Similarly, the interference between the upper blade 132 and the pressure die 2 must be avoided when the reverse-bending is to be carried out by the use of the lower blade 131.

It is also necessary that the eccentricity in the shaft D is equal to the sum of the movement of the bending die required to switch between the upward and reverse bending modes and the movement of the bending die required to perform the bending process. As a result, the bending machine requires a relative large power with increase of its size.

Such a structure as shown in FIG. 6 is also known.

This structure includes a bend beam 110*b* having its vertical cross-section of substantially inverted C-shaped configuration, and upper and lower bending dies 108 and 109 each of which includes a blade disposed to face the center.

The bend beam 110*b* including the bending dies mounted thereon is slidable along so-called LM guide blocks 124 and LM (Linear Motion) guide rails 125A in the vertical direction.

When the bending process is to be switched between the upward and reverse directions, the bending process can be carried out after the bending die 108 or 109 has been moved to a position near the plate through the LM guide mechanism without exchanging the bending die as in the arrangement of FIG. 4.

This structure of FIG. 6 is advantageous in that since the blades face the center, the rigidity can easily be ensured against the horizontal pressure from the horizontal bend arm 111*b* cooperating with the vertical bend arm 112*b* in its vertical movement when a plate is to be subjected to pushing-bending or ironing-bending.

Since the upward-bending die 109 is separated from the reverse-bending die 108, furthermore, it is relatively easy to avoid the interference of the bending die that is not used for bending.

Since the tip end of the plate interferes with the inner C-shaped wall of the bend beam 110*b*, however, the width of the plate to be bent is restricted.

Furthermore, the use of the LM guide mechanism causes shaking on bending. Additionally, the production cycle would be elongated since time required to perform the mode-switching step was relatively long in comparison with the structure of FIG. 4.

SUMMARY

In view of the technical problems raised by the aforementioned conventional art, the present invention has an object to provide a plate bending machine which bends a plate clamped between a lower die and a pressure die by a blade of a bending die mounted on a bend beam which is controlled in the vertical and horizontal directions, the plate bending machine being a bending structure in which the upward and reverse bending modes can easily be switched from one to another, the range of a bending trace can broadly be set by using the bending die selectively, and the size of the system can be effectively reduced.

To this end, the present invention provides, in its first aspect, a plate bending machine which bends a plate clamped between a lower die and a pressure die by a blade of a bending die which is controlled in the vertical and horizontal directions, wherein the bend beam is formed to have a vertical cross-section of substantially C-shaped configuration, wherein a first bending die is attached to an upper portion of the substantially C-shaped configuration and a second bending die is attached to a lower portion of the substantially C-shaped configuration, and wherein a blade formed on at least one of the first and second bending dies so as to extend in both the upward and downward directions.

In the second feature of the present invention, the bend beam may be connected to one end of a horizontal bend arm disposed substantially horizontal to the machine, the other end of the horizontal bend arm being connected to an eccentric shaft (or shaft A), and the horizontal bend arm may be connected to one end of a vertical bend arm which is disposed substantially vertical to the machine by an eccentric shaft (shaft B), the other end of the vertical bend arm being connected to an eccentric shaft (shaft D).

In such a manner, the bending die structure shown in FIG. 4 can be combined with the bending die arrangement shown in FIG. 6. Therefore, any interference between the pressure die, lower die, plate and the like can easily be avoided by selectively using the bending dies with increase of the range of bending while providing easy switching between the upward and reverse bending modes without exchange of the bending dies.

In particular, since the vertical movement of the bend beam can be shared also by the eccentric shaft (shaft B) when the horizontal and vertical bend arms are connected to each other by this shaft B, the output of the shaft D can dramatically be reduced in comparison with the case of using the shaft D only.

Thus, the output of the shaft D can exponentially be increased rather than that it is simply proportional to the length of the vertical stroke.

Moreover, shaking due to the LM guide can be prevented since it is not used. In addition, the mode-switching time can be shorter than that of the LM guide.

Thus, the entire size of the plate bending machine can be reduced.

In accordance with the present invention, the bend beam has its vertical cross-section of substantially C-shaped configuration, the first bending die being attached to an upper portion of this substantially C-shaped configuration, the second bending die being attached to a lower portion of the same, and the blade being formed on at least one of the first and second bending dies so as to extend in both the upward and downward directions. Therefore, any of the bending dies can easily be selected and used. The outward-directed blade on the substantially C-shaped bend beam can be used to perform a deep bending which is a large width bending. The inward-directed blade can be used to provide a wide range of bending trace.

Since the vertical movement of the bend beam can be shared also by the eccentric shaft (shaft B) when the horizontal and vertical bend arms are connected to each other by this shaft B, the output of the shaft D can dramatically be reduced in comparison with the case of using the shaft D only. As a result, the similar effect can be provided by the use of a smaller facility.

Moreover, shaking caused when using the LM guide can be prevented since it is not used. The switching adjustment can more be facilitated than that of the LM guide.

BRIEF DESCRIPTION OF THE SEVERAL VIEWS OF THE DRAWING

FIG. 2 B is a top plan view illustrating a main part which includes the shaft A, shaft B, bend beam and horizontal bend arm.

FIG. 5 B is a top plan view of a main part which includes the shaft A, bend beam and horizontal bend arm in the conventional plate bending machine.

DETAILED DESCRIPTION OF THE EMBODIMENT

Embodiments of the present invention will hereinafter be described with reference to the accompanying drawings.

Figure 3:
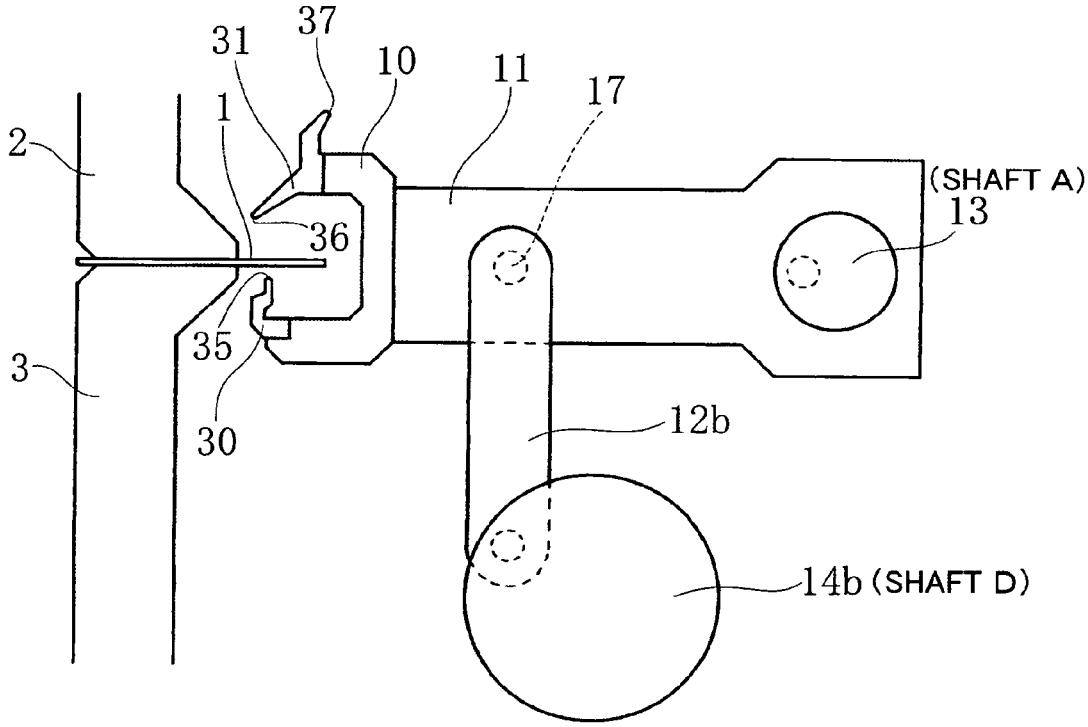
FIG. 3 is a side view of a main part of a first example of the plate bending machine according to the present invention.

FIG. 3 is a side view illustrating a main part of a first example of a plate bending machine according to the present invention.

A bend beam 10 has a vertical cross-section of substantially inverted C-shape and includes a first bending die 31 attached to an upper part of this substantially inverted C-shaped configuration and a second bending die 30 attached to a lower part of the same.

The second bending die 30 includes an upward-directed blade 35 mounted on the tip end thereof. The first bending die 31 includes an upward-directed blade 37 and a downward-directed blade 36 each of which extends in the upward or downward direction.

The bend beam 10 is fixedly connected to one end of a horizontal bend arm 11 disposed substantially horizontally.

The other end of horizontal bend arm 11 is connected with a shaft A (or eccentric shaft 13). The horizontal bend arm 11 is connected to the upper end of a vertical bend arm 12*b* which is disposed substantially vertically, through a pivot 17.

The lower end of vertical bend arm 12*b* is connected to a shaft D (or eccentric shaft 14*b*).

The shaft A (or eccentric shaft 13) and shaft D (or eccentric shaft 14*b*) are connected to a base (not shown).

When the shaft A (or eccentric shaft 13) rotates, the horizontal bend arm 11 swings in the horizontal direction so that the bending dies 31 and 30 mounted on the respective tip ends of the substantially inverted C-shape in the fixedly connected bend beam 10 swing in the horizontal direction.

When the shaft D (or eccentric shaft 14*b*) rotates, the vertical bend arm 12*b* connected to the horizontal bend arm 11 through the pivot 17 swings in the vertical direction so that the bending dies 31 and 30 on the bend beam 10 swing through the horizontal bend arm 11 in the vertical direction.

The position of each of the bending dies is controlled through the rotations of the shaft A (or eccentric shaft 13) and shaft D (or eccentric shaft 14*b*) in the vertical and horizontal directions.

The upward bending is usually carried out by clamping a plate 1 between the lower die 3 and the pressure die 2 and upward pressing it at the approaching position in the underside of the plate 1 through the blade 35 in the second bending die 30 which is mounted on the lower tip end of the C-shaped bend beam 10.

The reverse-bending is carried out by downward pressing the plate 1 through the leftward-directed blade 36 in the first bending die 31 which is mounted on the upper tip end of the C-shaped bend beam 10.

When the bending is to be performed to provide a width of bending larger than the depth in the C-shaped configuration of the bend beam 10, the rightward and upward directed blade 37 in the first bending die mounted on the upper tip end of the C-shaped configuration is used to upward press the plate 1 at the approaching position in the underside of the plate 1.

Figure 1:
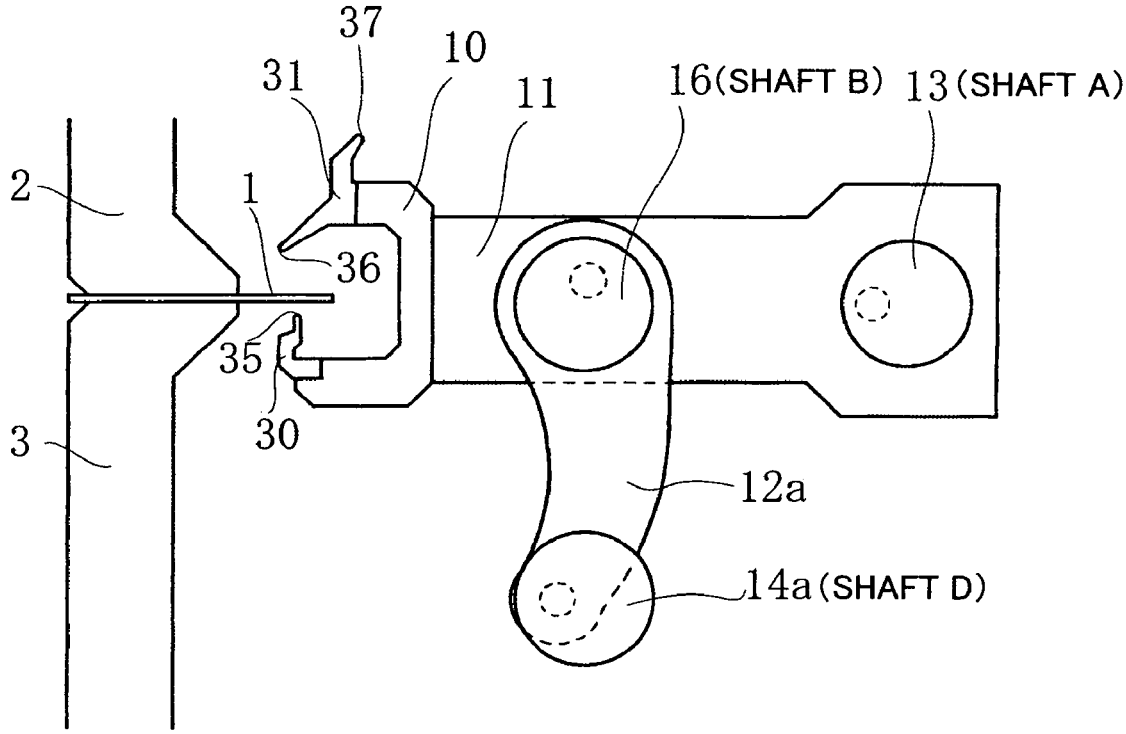
FIG. 1 is a side view of a main part of a first example of a plate bending machine according to the present invention.

FIG. 1 is a side view illustrating a main part of a second example of the plate bending machine according to the present invention.

A bend beam 10 has a vertical cross-section of substantially inverted C-shape and includes a first bending die 31 being attached to the upper portion of this substantially inverted C-shaped configuration and a second bending die 30 being attached to the lower portion of the same.

The second bending die 30 includes an upward-directed blade 35 mounted on the tip end thereof. The first bending die 31 includes an upward-directed blade 37 and a downward-directed blade 36, each of which extends in the upward or downward direction.

The bend beam 10 is fixedly connected to the leftward end of a horizontal bend arm 11 disposed substantially horizontally.

The rightward end of horizontal bend arm 11 is connected to a shaft A (or eccentric shaft 13). The horizontal bend arm 11 is connected to the upper end of a vertical bend arm 12*b* which is disposed substantially vertically, through a shaft B (or eccentric shaft 16).

The lower end of vertical bend arm 12*b* is connected to a shaft D (or eccentric shaft 14*b*).

The shaft A (or eccentric shaft 13) and shaft D (or eccentric shaft 14*b*) are connected to a base (not shown).

When the shaft A (or eccentric shaft 13) rotates, the horizontal bend arm 11 swings in the horizontal direction so that the bending dies 31 and 30 mounted on the respective tip ends of the substantially inverted C-shape in the fixedly connected bend beam 10 swing in the horizontal direction.

When the shaft D (or eccentric shaft 14*a*) rotates, the vertical bend arm 12*a* connected to the horizontal bend arm 11 through the shaft B (or eccentric shaft 16) swings in the vertical direction so that the bending dies 31 and 30 on the bend beam 10 swing through the horizontal bend arm 11 in the vertical direction.

When the shaft B (or eccentric shaft 16) rotates, the relative position between the horizontal bend arm 11 and the vertical bend arm 12*a* is changed.

By rotation of this shaft B (or eccentric shaft 16), the vertical bend arm 12*a* swings horizontal to the horizontal bend arm 11 while the horizontal bend arm 11 swings vertical to the vertical bend arm 12*a*.

For such a reason, the swingable width of the horizontal bend arm 11 in the vertical direction will be equal to the sum of the swinging width of the shaft B (or eccentric shaft 16) and the swinging width of the shaft D (or eccentric shaft 14*a*) while the swingable width in each of the bending dies 30 and 31 is similarly equal to the sum of the swinging width of the shaft B (or eccentric shaft 16) and the swinging width of the shaft D (or eccentric shaft 14*a*).

Figure 4:
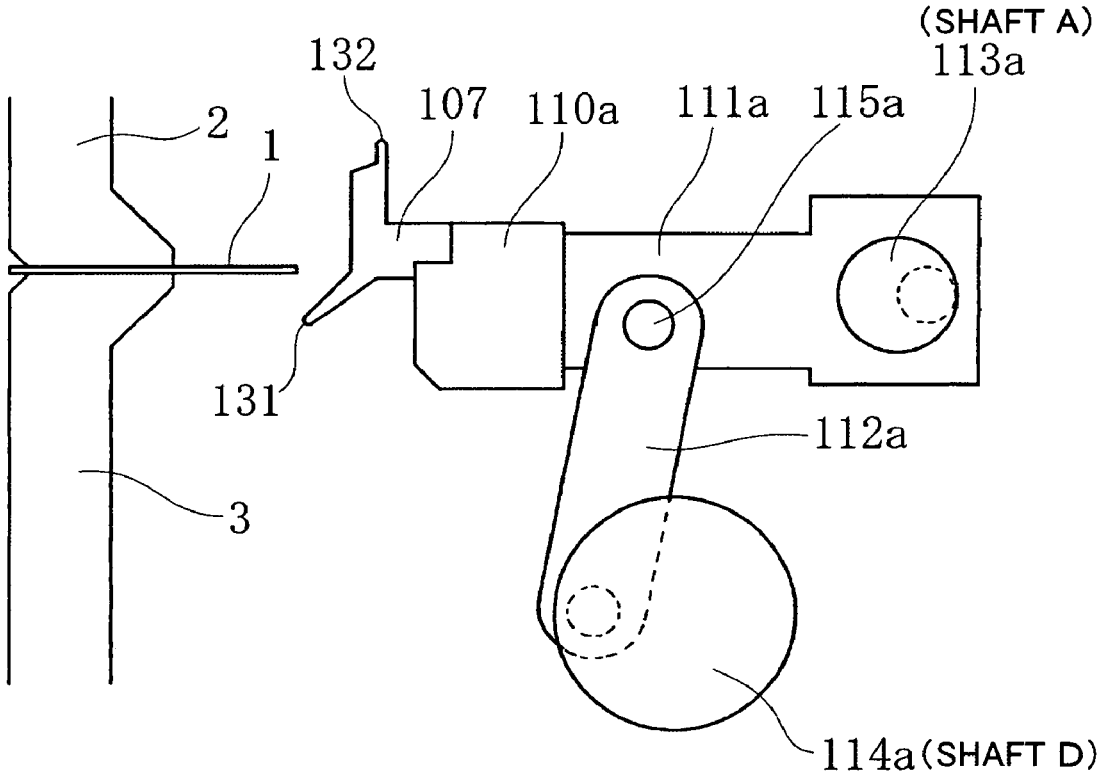
FIG. 4 PRIOR ART
FIG. 4 is a side view of a main part of a conventional plate bending machine.
Figure 5A:
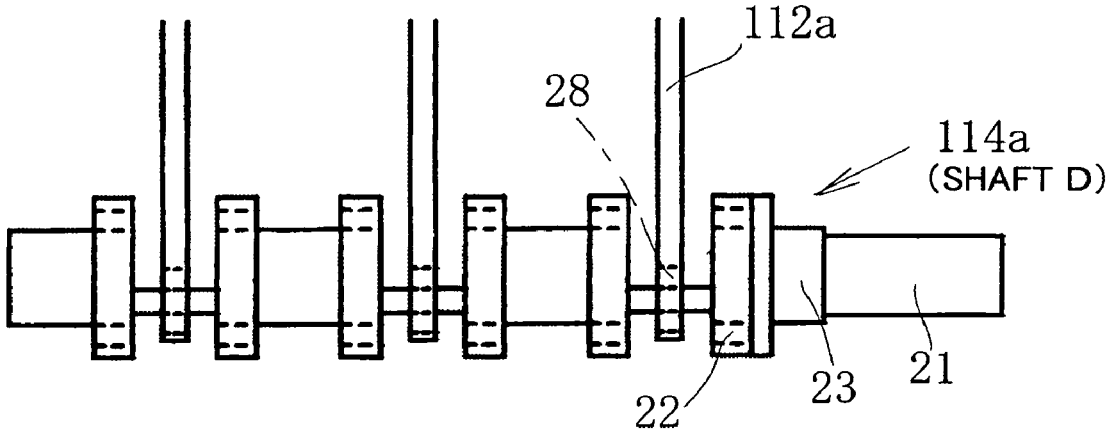
FIG. 5A PRIOR ART
FIG. 5 A is a front view of a main part of the shaft D portion in the conventional plate bending machine.
Figure 5B:
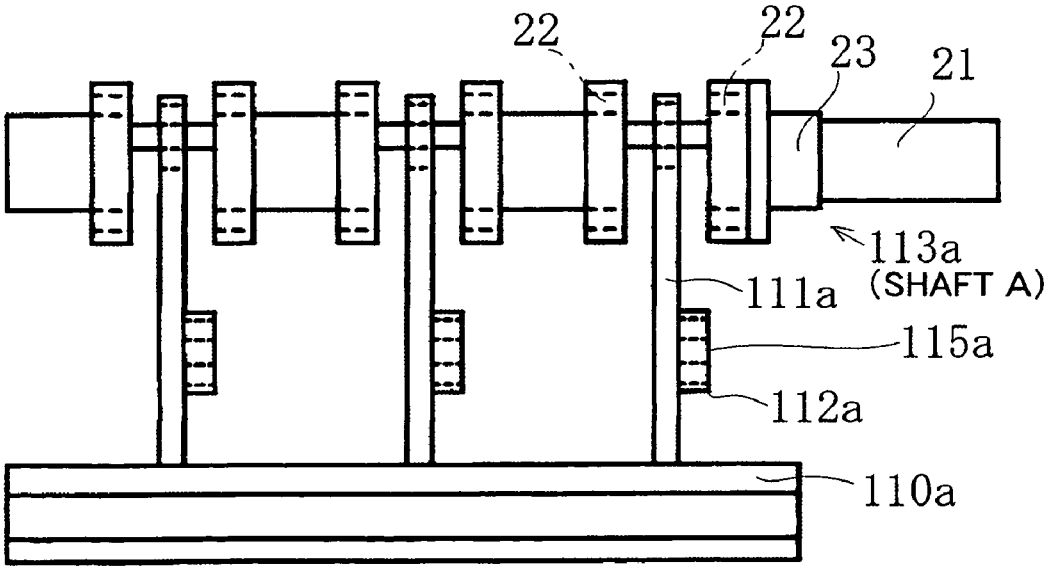
FIG. 5B PRIOR ART

In comparison with the example of FIG. 4 in which only the shaft D (or eccentric shaft 114*a*) is used to move the bending die 107 in the vertical direction, thus, the bending machine of the present invention may have the same width combined with the swinging widths of two shafts to provide the same swingable width when the shaft B (or eccentric shaft 16) and shaft D (or eccentric shaft 14*a*) are identical in diameter and eccentricity with each other. As a result, the diameter of each of the shafts may be reduced half in the case of FIG. 4 while the whole cross-sectional area of the two shafts may be reduced half. Therefore, the entire size of the bending machine can be reduced.

The plate 1 can be bent by causing any one of the blades 35, 36 and 37 to press the plate 1 under the co-operation of the shaft A (or eccentric shaft 13), shaft B (or eccentric shaft 16) and shaft D (or eccentric shaft 14*a*) so that the blade will follow the trace of bending.

Although each of the second and first bending dies 30 and 31 has upper and lower gaps, the switching between the upward and reverse bending modes can easily be carried out since the bending dies can be moved in the vertical direction when the shaft B and D are rotated.

Figure 6:
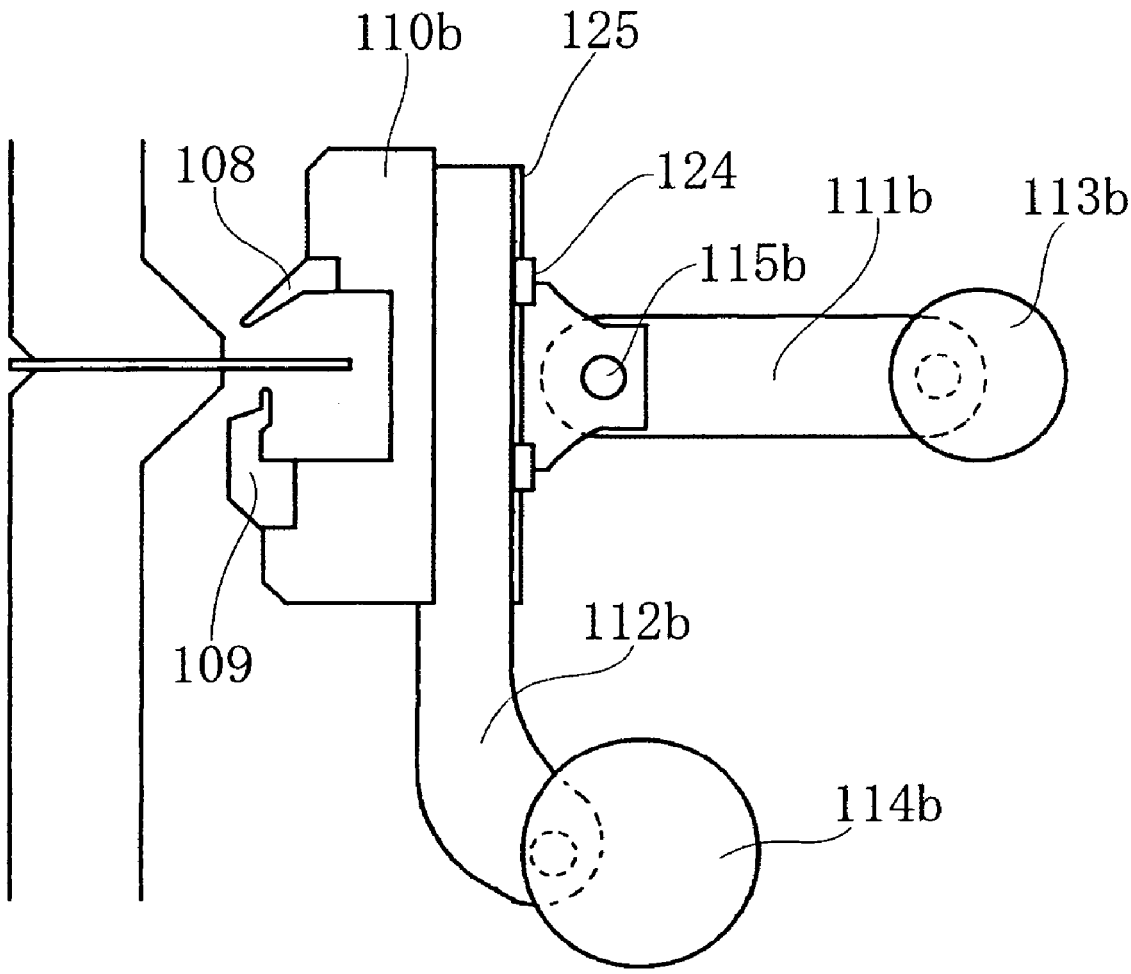
FIG. 6 PRIOR ART
FIG. 6 is a side view of a main part of a conventional plate bending machine in which the bend beam is of a substantially C-shaped cross-section.

With the plate bending machine of the present invention, since the swingable width of each of the bending dies in the vertical direction can be increased, it is not necessary to use an LM guide as in the example of FIG. 6. Therefore, shaking to be caused by using the LM guide can be prevented with more easy adjustment.

Figure 2A:
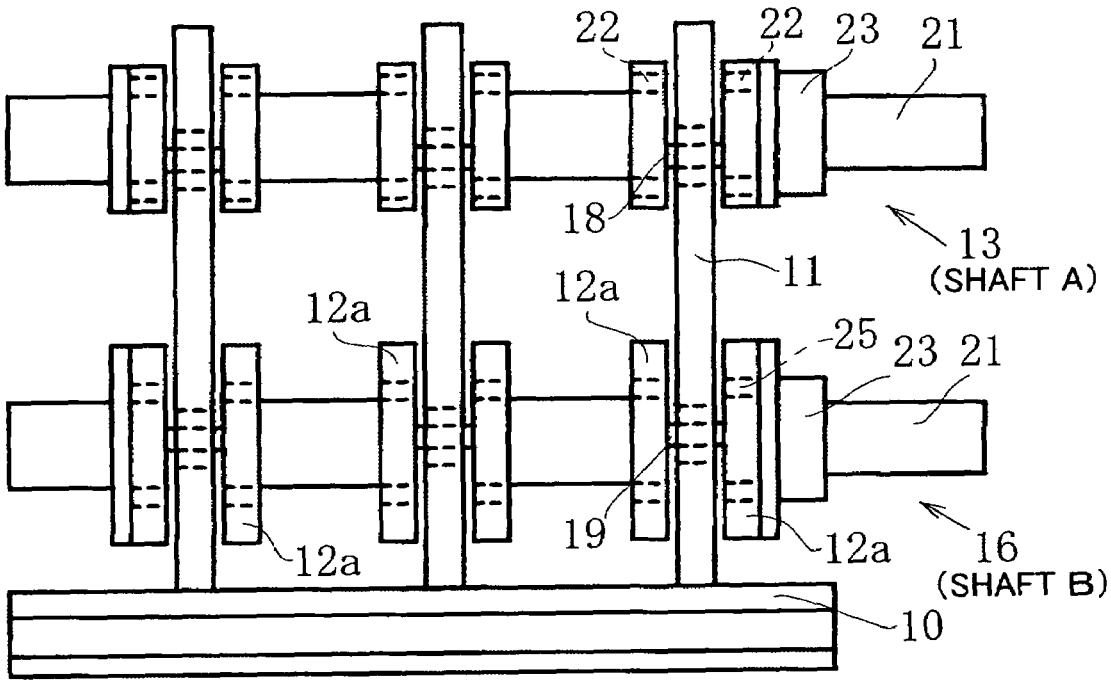
FIG. 2 A is a front view of a main part of the shaft D section.
Figure 2B:
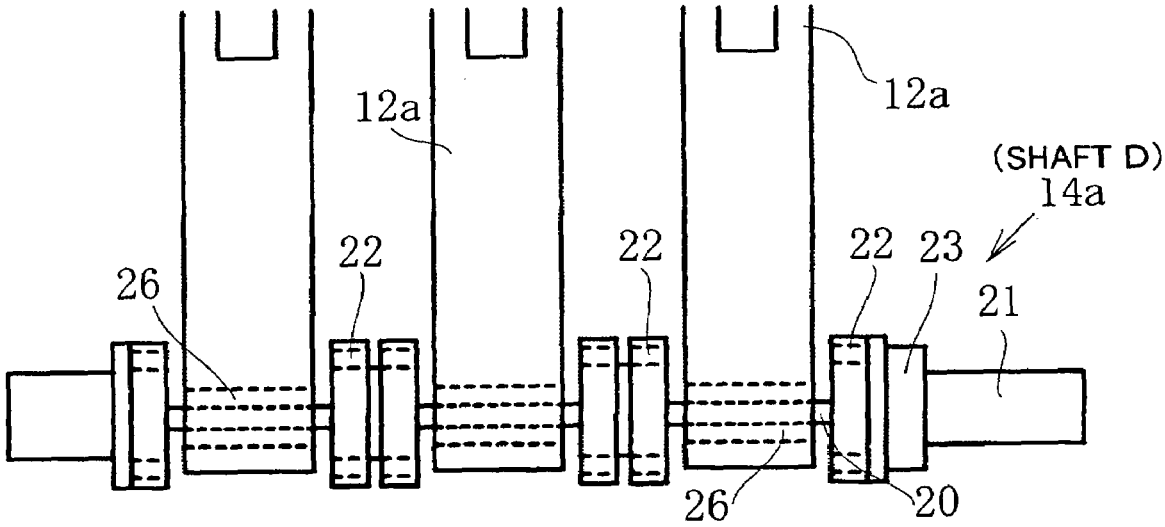

FIG. 2 A is a front view of a main part of the shaft D section. FIG. 2 B is a top plan view illustrating a section which includes the shaft A, shaft B, bend beam and horizontal bend arm.

The shaft A (or eccentric shaft 13), shaft B (or eccentric shaft 16) and shaft D (or eccentric shaft 14*a*) are rotated by a motor 21 through a speed reducer 23.

The shaft A (or eccentric shaft 13) is connected to a base (not shown) through a bearing 22. Similarly, the shaft D (or eccentric shaft 14*a*) is connected to the base (not shown) through the bearing 22.

The shaft B (or eccentric shaft 16) is connected to each of the vertical bend arms 12*a* through a bearing 25.

The horizontal bend arm 11 is connected to the shaft A through an eccentric shaft 18.

Similarly, the horizontal bend arm 11 is connected to the shaft B through an eccentric shaft 19.

The vertical bend arms are connected to the shaft D through an eccentric shaft 20.

Although FIG. 2 exemplifies three vertical bend arms, the number of these arms may be two or will not be limited in number.

In the field where the plate is bent by the blade under co-operation of the pressure and lower dies, the plate bending machine according to the present invention can easily perform the mode-switching between the upward and reverse bending modes and increase the range of bending trace. Accordingly, it can be used for various deep bending and the like of the plate.

What is claimed is:

1. A plate bending machine which comprises a bend beam and a bending die, and bends a plate clamped between a lower die and a pressure die by a blade formed on the bending die, position of the bend beam being controlled in the vertical and horizontal directions and the bending die being mounted on the bend beam, wherein the bend beam is formed to have a vertical cross-section of substantially C-shaped configuration, wherein a first bending die is attached to an upper portion of the substantially C-shaped configuration and a second bending die is attached to a lower portion of the substantially C-shaped configuration, wherein at least one of the first bending die and the second bending die includes a first blade extending in an upward direction and a second blade extending in a downward direction, each of the first and the second blades functions as a bending blade.

2. The plate bending machine as defined in claim 1, comprising:

horizontal bend arms each of which is disposed substantially horizontal to the plate bending machine;

vertical bend arms each of which is disposed substantially vertical to the horizontal bend arms;

a first eccentric shaft; and a second eccentric shaft, wherein one end of each of the horizontal bend arms is connected to the bend beam, wherein the other end of each of the horizontal bend arms is connected to the first eccentric shaft, wherein a pivot is formed between the both ends of each of the horizontal bend arms, wherein one end of each of the vertical bend arms is connected to corresponding one of the horizontal bend arms through the pivot, and wherein the other end of each of the vertical bend arms is connected to the second eccentric shaft.

3. The plate bending machine as defined in claim 1, comprising:

horizontal bend arms each of which is disposed substantially horizontal to the plate bending machine;

vertical bend arms each of which is disposed substantially vertical to the horizontal bend arms;

a first eccentric shaft; and a second eccentric shaft; and a third eccentric shaft, wherein one end of each of the horizontal bend arms is connected to the bend beam, wherein the other end of each of the horizontal bend arms is connected to the first eccentric shaft, wherein each of the horizontal bend arms is connected to the third eccentric shaft at a position between the both ends of each of the horizontal bend arms, wherein one end of each of the vertical bend arms is connected to corresponding one of the horizontal bend arms through the third eccentric shaft, and wherein the other end of each of the vertical bend arms is connected to the second eccentric shaft.

4. The plate bending machine as defined in claim 2, wherein the first eccentric shaft and the second eccentric shaft are connected to a base.

5. The plate bending machine as defined in claim 3, wherein the first eccentric shaft and the second eccentric shaft are connected to a base.

6. The plate bending machine as defined in claim 3, wherein the first eccentric shaft, the second eccentric shaft, and the third eccentric shaft are rotated by a motor.

7. The plate bending machine as defined in claims 1, wherein the first bending die includes the first blade and the second blade, wherein the first blade bends the plate by pressing the plate upward from an approaching position under the plate, and wherein the second blade bends the plate by pressing the plate downward.

8. The plate bending machine as defined in claim 7, wherein the first blade extends slantingly toward the bend beam with respect to a direction perpendicular to the horizontal bend arms, and wherein the second blade extends slantingly toward the pressure die with respect to the direction perpendicular to the horizontal bend arms.

* * * * *